US005520527A

United States Patent [19]

Kim

[11] Patent Number: 5,520,527

[45] Date of Patent: May 28, 1996

[54] APPARATUS FOR ADJUSTING ORBITAL RADIUS IN A SCROLL COMPRESSOR

[75] Inventor: Joong H. Kim, Seoul, Rep. of Korea

[73] Assignee: Goldstar Co., Ltd., Seoul, Rep. of Korea

[21] Appl. No.: 365,941

[22] Filed: Dec. 29, 1994

[30] Foreign Application Priority Data

Dec. 30, 1993 [KR] Rep. of Korea ..... 1993-31414

[51] Int. Cl.[6] ..... F04C 18/04

[52] U.S. Cl. ..... 418/55.5; 418/57

[58] Field of Search ..... 418/55.5, 57

[56] References Cited

U.S. PATENT DOCUMENTS

| | | | |
|---|---|---|---|
| 4,065,279 | 12/1979 | McCullough | 418/55.5 |
| 4,082,484 | 4/1978 | McCullough | 418/55.5 |
| 4,927,340 | 5/1990 | McCullough | 418/55.5 |
| 5,174,739 | 12/1992 | Kim | 418/55.5 |

FOREIGN PATENT DOCUMENTS

| | | | |
|---|---|---|---|
| 2-45672 | 2/1990 | Japan | 418/55.5 |
| 5248372 | 9/1993 | Japan | 418/55.5 |

*Primary Examiner*—John J. Vrablik

[57] ABSTRACT

An apparatus for adjusting an orbital radius in a scroll compressor includes transmitting elements driving an orbiting scroll in accordance with the movement of a driving shaft and a stopper controlling the moving range of the transmitting elements with respect to the center of the driving shaft. The transmitting elements, including a bushing, are movably provided between the driving shaft and the orbiting scroll, so as to allow the distance between the center of the driving shaft and the center of the transmitting elements to change. The stopper is assembled to the transmitting elements in order that the position of the stopper is controllable. As for the stopper, there is provided a screw which is fastened into a screw hole formed on one side of the driving shaft or the bushing, thereby limiting movement of the driving shaft or the bushing.

2 Claims, 5 Drawing Sheets

APPARATUS FOR ADJUSTING ORBITAL RADIUS IN A SCROLL COMPRESSOR

BACKGROUND OF THE INVENTION

The present invention relates to a scroll compressor, and more particularly to an apparatus for adjusting an orbital radius in a scroll compressor, which maintains a distance between centers of a driving shaft and a bushing, thereby determining a radial gap between scroll wraps of a compression chamber to a desired value irrespective of machining and assembling errors.

Referring to FIG. 1, a conventional scroll compressor includes a fixed scroll 1, an orbiting scroll 2, a rotation preventing device 3, and a driving shaft 4. The fixed scroll 1 and orbiting scroll 2 have involute or spiral wraps, respectively. The fixed scroll 1 is fixed to a main frame. The orbiting scroll 2 exhibits an orbital movement by the driving shaft 4 rotated by a motor 5, because the rotation of the orbiting scroll 2 is prevented by the rotation preventing device 3. The orbital movement of the orbiting scroll 2 with respect to the fixed scroll 1 changes the volume of a compression chamber provided therebetween, thereby compressing a refrigerant gas. FIG. 1 also shows a driving pin 4*a* formed eccentrically at the upper end of the driving shaft 4.

In the conventional scroll compressor, the width of the radial gap between the wrap of the fixed scroll 1 and the wrap of the orbiting scroll 2 is very important. If the gap is too wide, compressed gas will be leaked. On the contrary, if there is no gap, the wraps come into contact with each other and a frictional force between the wraps increases.

As shown in FIGS. 2 and 3, an orbital radius of the orbiting scroll 2, that is, the distance between the center A of the driving shaft 4 and the center C of a bushing 7, is the most important factor to influence the gap between the scroll wraps. The bushing 7 receives the driving pin 4*a* formed eccentrically at the upper end of the driving shaft 4 and drives the orbiting scroll 2. Generally, if the distance between the center A of the driving shaft 4 and the center C of the bushing 7 is variable, a reliability of the scroll compressor is improved.

When the orbital movement is not performing normally due to an excessive force, for example, due to an obstacle interposed between the scroll wraps or due to attempting to compress a liquid, the bushing 7 moves with respect to the driving pin 4*a*, thereby increasing the gap between the scroll wraps and consequently moving the orbiting scroll 2 in the same direction. On the contrary, in normal conditions of operation, the bushing 7 moves so as to allow the gap between the scroll wraps to vary in accordance with the centrifugal force of the orbiting scroll 2, the gas pressure of the compression chamber, or the like, to become an optimal minimum value.

Referring to FIGS. 3A and 3B, there is provided a stopper 8' for limiting the relative movement of the bushing 7 with respect to the center B of the driving pin 4*a* to a predetermined extent. In this situation, when the orbital movement is normal, the distance between the center A of the driving shaft 4 and the center C of the bushing 7, that is, the orbital radius, becomes maximized within the predetermined range, and at the same time the radial gap between the wrap of the fixed scroll 1 and the wrap of the orbiting scroll 2 becomes minimized. On the other hand, when the orbital movement is not within a normal range of positions due to an excessive load (for example, an obstacle is interposed between the scroll wraps or a liquid is to be compressed), the bushing 7 moves so as to allow the distance between the center A of the driving shaft 4 and the center C of the bushing 7 to become narrower, thereby increasing the radial gap between the scroll wraps. At this time, the stopper 8' determines a minimal orbital radius, that is, a maximal gap between the scroll wraps.

As described above, if the minimal radial gap between the scroll wraps is too wide, compressed gas leakage increases. On the contrary, if too narrow, the frictional force between the scroll wraps increases. Therefore, the maximal distance between the center A of the driving shaft 4 and the center C of the bushing 7, (that is, the minimal gap between the scroll wraps) is important.

However, the range of the radial gap cannot be maintained to a designed value because of accumulated errors, for example, machining errors of eccentricity between the center A of the driving shaft 4 and the center B of the driving pin 4*a*, machining and assembling errors of the inner circumference of the bushing 7 and the outer circumference of the driving pin 4*a* inserted into the bushing 7, and machining and assembling errors of the stopper 8'.

SUMMARY OF THE INVENTION

It is an object of the present invention to provide an apparatus for adjusting an orbital radius in a scroll compressor which comprises transmitting means for driving an orbiting scroll in accordance with the movement of a driving shaft and limiting means for controlling the moving range of the transmitting means with respect to the center of the driving shaft.

The transmitting means is movably provided between the driving shaft and the orbiting scroll so as to allow the distance between the center of the driving shaft and the center of the transmitting means to change. The limiting means is assembled to the transmitting means in order that the position of the limiting means is controllable.

According to one embodiment of the present invention, the transmitting means includes a driving pin formed eccentrically at the upper end of the driving shaft and a bushing, into which the driving pin is fitted, inserted into a female boss of the orbiting scroll. It is preferable that the bushing is an eccentric bushing rotating eccentrically with respect to the driving shaft, or a sliding bushing performing a sliding movement with respect to the driving shaft.

In addition, it is preferable that the limiting means is a screw fastened into a screw hole, formed radially in the bushing. In this case, one end portion of the screw is protruded into the inside of an eccentric hole or an insertion hole of the bushing.

According to another embodiment of the present invention, the transmitting means includes a male boss, formed at a lower surface of the orbiting scroll, and a block type bushing, into which the male boss is fitted, inserted into an insertion groove, the center of which is formed eccentrically with respect to the center of the driving shaft at the upper end of the driving shaft. The block-type bushing includes an insertion hole, into which the male boss is fitted, and flat surfaces which come into sliding contact with the insertion groove formed at the upper end of the driving shaft.

It is preferable that the limiting means is a screw fastened into a screw hole formed radially in the driving shaft. An elastic member can be inserted into the insertion groove of the driving shaft on the opposite side with respect to the screw.

In the foregoing, it is also preferable that a radial gap between a wrap of the orbiting scroll and a wrap of a fixed scroll is above zero when an orbital radius, that is, the distance between the center of the driving shaft and the center of the bushing, is a maximum value within a variable range.

DETAILED DESCRIPTION OF THE INVENTION

Preferred embodiments of the present invention are described in detail hereinafter by accompanying drawings.

Figure 1:
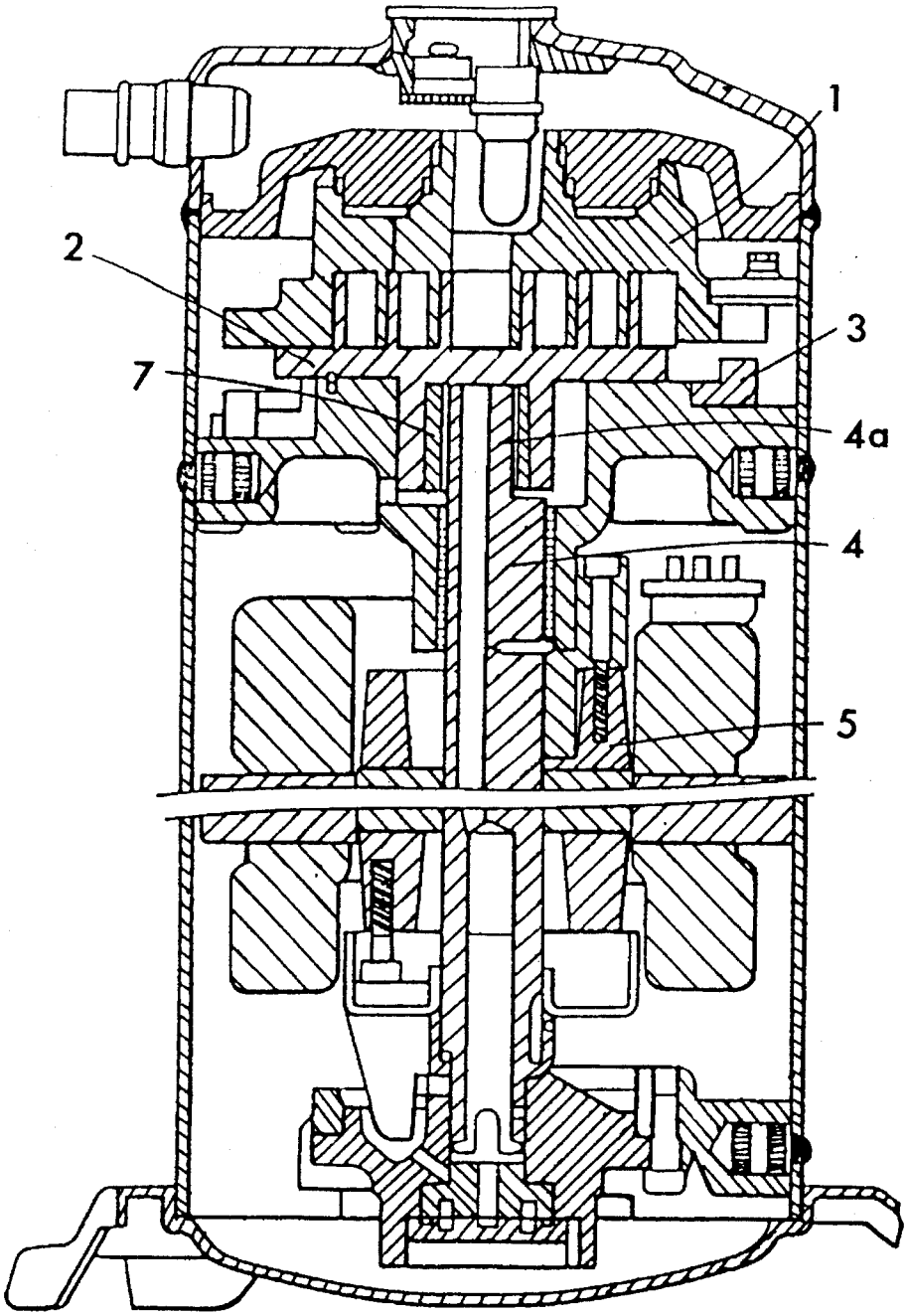
FIG. 1 PRIOR ART
FIG. 1 is a vertical sectional view of a conventional scroll compressor.
Figure 2A:
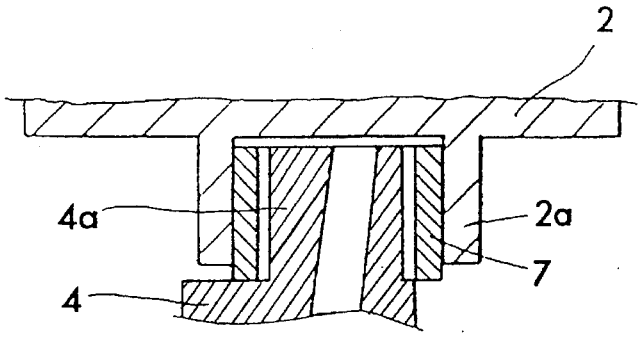
FIG. 2A PRIOR ART
FIG. 2A is an enlarged fragmentary sectional view of a portion of a conventional scroll compressor, particularly showing an orbiting scroll, a sliding bushing, and a driving shaft.
Figure 2B:
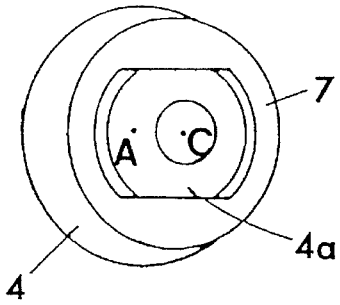
FIG. 2B PRIOR ART
FIG. 2B is a plan view of FIG. 2A, particularly showing the sliding bushing and the driving shaft.
Figure 3A:
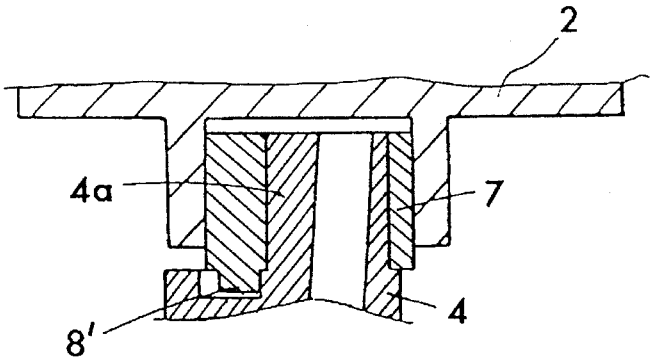
FIG. 3A PRIOR ART
FIG. 3A is an enlarged fragmentary sectional view corresponding to FIG. 2A, but showing an eccentric bushing.
Figure 3B:
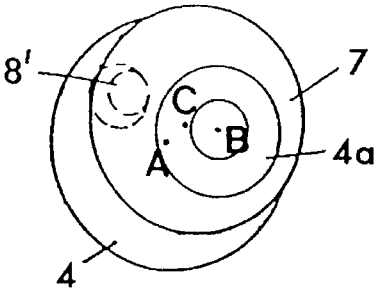
FIG. 3B PRIOR ART
FIG. 3B is a plan view of FIG. 3A, particularly showing the eccentric bushing and the driving shaft.
Figure 4A:
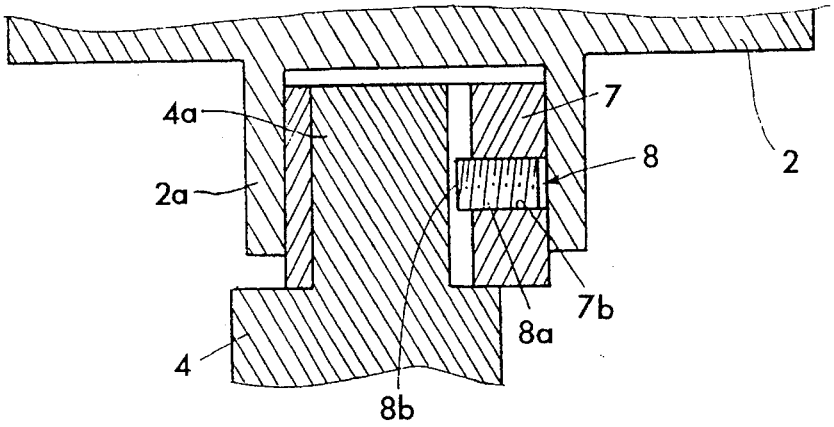
FIG. 4A is an enlarged fragmentary sectional view of an apparatus for adjusting an orbital radius in a scroll compressor in accordance with one embodiment of the present invention.
Figure 4B:
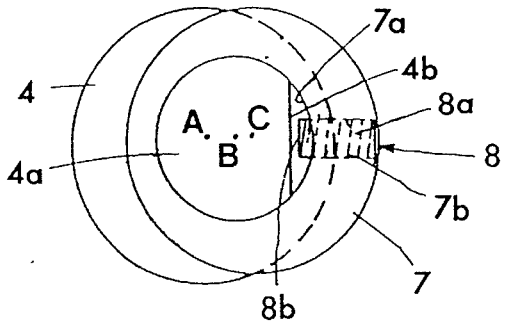
FIG. 4B is a plan view of FIG. 4A, particularly showing a bushing and a driving shaft.

Referring to FIGS. 4A and 4B, a variable range of an orbital radius, that is, a range of a distance between the center A of the driving shaft 4 and the center C of a bushing 7, is measured, and subsequently the range of the distance is controlled within a desired range of the orbital radius by the stopper 8 having a screw 8*a*, the position of which is controllable. After this, the stopper 8 is fixed, so that the range of the distance can be maintained to a desirably designed value irrespective of accumulated errors.

As shown in FIGS. 4A and 4B, a portion of an outer surface of an eccentric driving pin 4*a* of the driving shaft 4 is cut so as to form a flat surface 4*b*. An eccentric hole 7*a*, into which the eccentric driving pin 4*a* is inserted, is formed in the bushing 7. The screw 8*a* is fastened into a screw hole 7*b*, formed radially in the bushing 7, which bushing is inserted into a female boss 2*a* of an orbiting scroll 2. An end portion 8*b* of the screw 8*a*, which is machined, is protruded into the inside of the eccentric hole 7*a* of the bushing 7, and is separated from the flat surface 4*b* of the eccentric driving pin 4*a* by a prescribed distance.

When the bushing 7 rotates with respect to the eccentric driving pin 4*a*, the end portion 8*b* of the screw 8*a* limits the range of a rotation angle in both clockwise and counterclockwise directions. In the limited range, the distance between the center A of the driving shaft 4 and the center C of the bushing 7 becomes the range of the orbital radius.

Figure 5A:
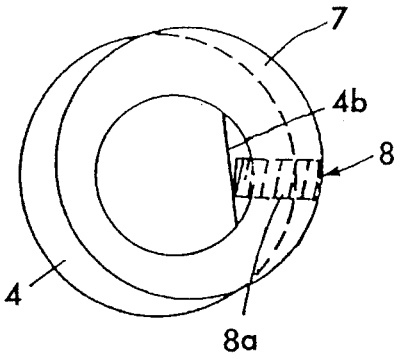
FIGS. 5A and 5B are plan views corresponding to FIG. 4B, particularly showing a variable range of an orbital radius of the bushing.
Figure 5B:
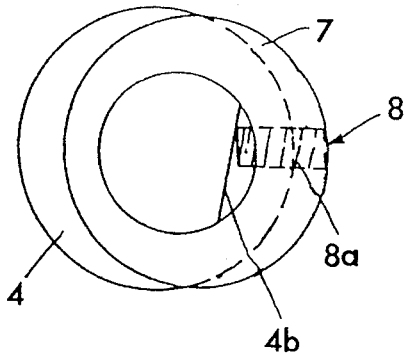

As shown in FIGS. 5A and 5B, when the bushing 7 is restrained in one direction by the stopper 8 having the screw 8*a*, the orbital radius is measured. Then, the orbital radius is controlled by the screw 8*a* to a desired value, and subsequently the screw 8*a* is fixed.

In this situation, when the orbital radius is maximized, the radial gap between the scroll wraps becomes minimized. Since the minimum value of the radial gap is more important than the maximum value, the orbital radius is preferably measured on the basis of the maximum value.

Figure 6A:
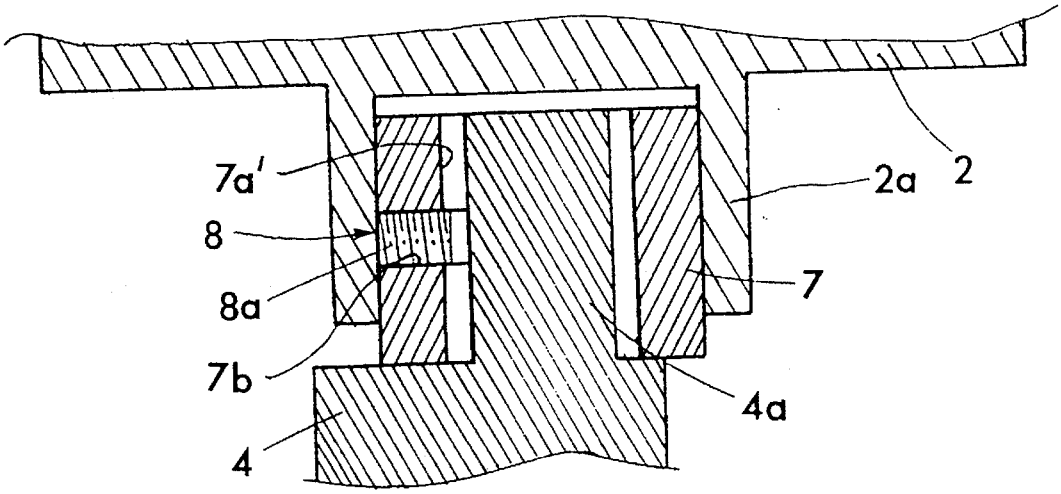
FIGS. 6A and 6B are an enlarged fragmentary sectional view and a plan view corresponding to FIGS. 4A and 4B, respectively, in accordance with another embodiment of the present invention.
Figure 6B:
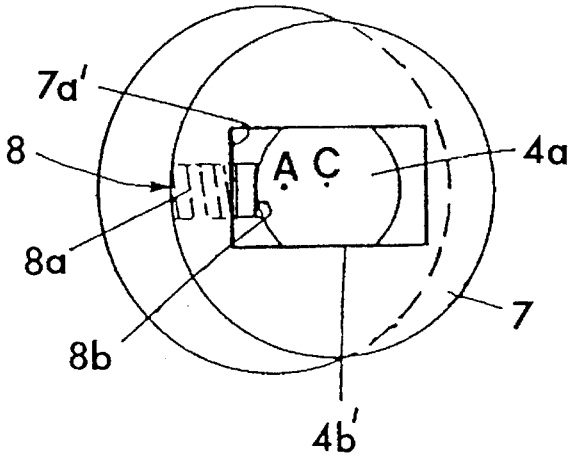

As shown in FIGS. 6A and 6B, an insertion hole 7*a*' is formed in the bushing 7, so as to receive an eccentric driving pin 4*a* having flat surfaces 4*b*'. A screw hole 7*b* is formed at one side of the bushing 7 which is closest to the center A of the driving shaft 4, and a screw 8*a* is fastened into the screw hole 7*b* so as to allow a precisely machined end portion 8*b* to be protruded into the inside of the insertion hole 7*a*' of the bushing 7.

In this embodiment, the bushing 7 moves along the flat surfaces 4*b*' of the eccentric driving pin 4*a*, until the surface of the eccentric driving pin 4*a*, which is closest to the center A of the driving shaft 4, comes into contact with the end portion 8*b* of the screw 8*a*. In this state, the maximum value of the orbital radius, that is, that of the distance between the center A of the driving shaft 4 and the center C of the bushing 7 is measured, and then the screw 8*a* is fixed after the radius is adjusted by the screw 8*a* satisfying the desirable value.

Figure 7A:
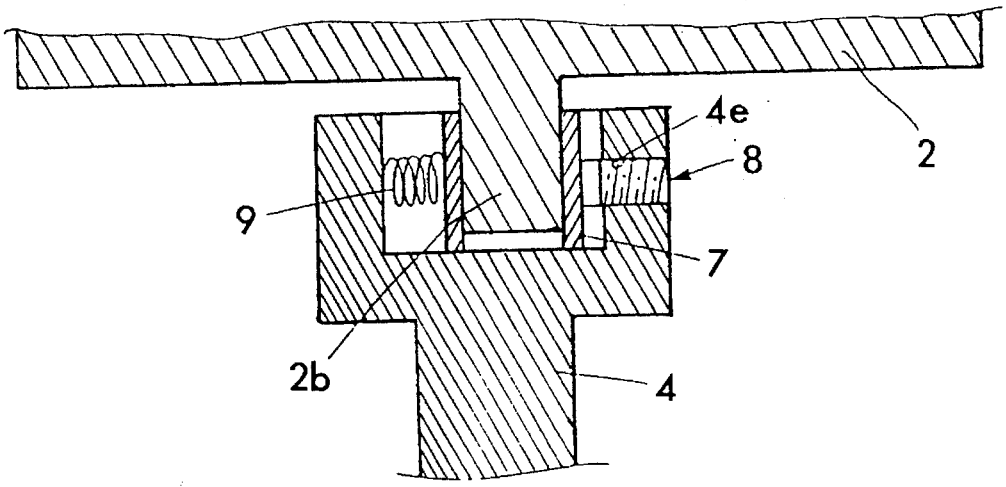
FIGS. 7A and 7B are an enlarged fragmentary sectional view and a plan view corresponding to FIGS. 4A and 4B, respectively, in accordance with a further embodiment of the present invention.
Figure 7B:
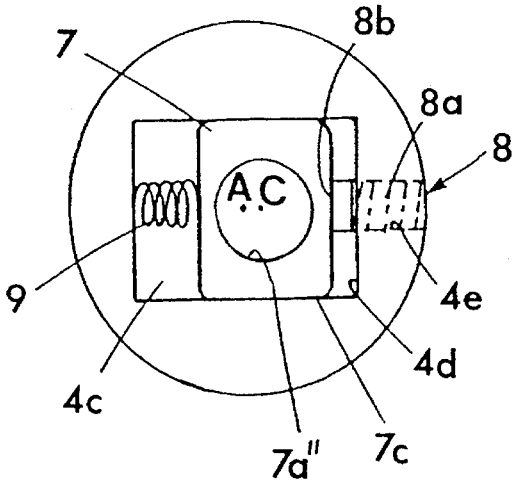

As shown in FIGS. 7A and 7B, a male boss 2*b* is formed in the opposite direction of the wrap of the orbiting scroll 2, and a block type bushing 7, which includes an insertion hole 7*a*", into which the male boss 2*b* is inserted, and flat surfaces 7*c*, capable of sliding movement, are provided. After the male boss 2*b* is inserted into the block type bushing 7, the block type bushing 7 is inserted into an insertion groove 4*c*, of the driving shaft 4, in which the block type bushing 7 can make a sliding movement. A screw 8*a*, having a precisely machined end portion 8*b*, is fastened into a screw hole 4*e* formed perpendicularly to an inner surface 4*d* farthest from the center A of the driving shaft 4 among inner surfaces of the insertion groove 4*c* of the driving shaft 4. In addition, an elastic member 9, such as a compression spring, is inserted into the insertion groove 4*c*, of the driving shaft 4, on the opposite side with respect to the screw 8*a*.

In this embodiment, the block type bushing 7 moves along the flat surfaces 7*c* and then comes into contact with the end portion 8*b* of the screw 8*a*. At this time, a distance between the center A of the driving shaft 4 and the center C of the insertion hole 7*a*" of the bushing 7, that is, the maximum value of the orbital radius is measured, the orbital radius is controlled to the desirable value by the screw 8*a*, and subsequently the screw 8*a* is fixed.

In the foregoing, when the orbital radius is a maximum value within a variable range, the radial gap between the wrap of the orbiting scroll and the wrap of the fixed scroll should be above zero, and more preferably, within a range of from 5 to 30 μm.

Therefore, according to the present invention, the driving shaft, the bushing, and the orbiting scroll can be assembled while the range of the orbital radius determining the radial gap between the scroll wraps, which has a great influence on efficiency and reliability of a scroll compressor, is maintained to the desirably designed value irrespective of machining and assembling errors of various parts.

While specific embodiments of the invention have been illustrated and described wherein, it is to realize that modifications and changes will occur to those skilled in the art, It is therefore to be understood that the appended claims are intended to cover all modifications and changes as they fall within the true spirit and scope of the invention.

What is claimed is:

1. An apparatus for adjusting an orbital radius in a scroll compressor comprising:

an orbiting scroll including a female boss;

a driving shaft;

transmitting means for driving said orbiting scroll in accordance with a movement of said driving shaft, said transmitting means being movably provided between said driving shaft and said orbiting scroll and including a driving pin formed eccentrically at an upper end of said driving shaft, and an eccentric bushing including an eccentric hole into which said driving pin is fitted, said eccentric bushing rotating eccentrically with respect to said driving shaft and inserted into said female boss of said orbiting scroll;

limiting means for controlling a moving range of said transmitting means, with respect to said center of said driving shaft, said limiting means being assembled to said transmitting means, wherein said limiting means is a screw fastened into a screw hole formed radially in said bushing, so as to allow an end portion of said screw to be protruded into an inside of said eccentric hole of said bushing.

2. An apparatus for adjusting an orbital radius in a scroll compressor as in claim 1, wherein a radial gap between a wrap of said orbiting scroll and a wrap of a fixed scroll is above zero when said distance between said center of said driving shaft and said center of said transmitting means is a maximum value.

* * * * *